United States Patent [19]

Spatz

[11] Patent Number: 4,635,659

[45] Date of Patent: Jan. 13, 1987

[54] MASCARA APPLICATOR

[75] Inventor: Walter Spatz, Los Angeles, Calif.

[73] Assignee: Spatz Laboratories, Inc., Marina Del Ray, Calif.

[21] Appl. No.: 568,415

[22] Filed: Jan. 5, 1984

[51] Int. Cl.[4] ..... A45D 40/26

[52] U.S. Cl. ..... 132/88.7; 264/243; 401/129

[58] Field of Search ..... 132/88.7, DIG. 3, 85; 401/129, 268, 126, 127, 122; 15/159, 187; 425/805; 264/243

[56] References Cited

U.S. PATENT DOCUMENTS

| | | | |
|---|---|---|---|
| 2,007,245 | 7/1935 | Gimonet | 132/88.7 |
| 2,180,533 | 11/1939 | Leffler | 132/88.7 |
| 3,107,665 | 10/1963 | Nordgren | 132/DIG. 1 |
| 3,363,635 | 1/1968 | Wurmbock | 132/88.7 |
| 3,892,248 | 7/1975 | Kingsford | 132/88.7 |
| 3,896,823 | 7/1975 | Spatz | 132/88.7 |
| 3,908,676 | 9/1975 | Levine et al. | 132/88.7 |
| 4,403,624 | 9/1983 | Montgomery | 132/88.7 |
| 4,404,977 | 9/1983 | Vasas | 401/129 |
| 4,422,986 | 12/1983 | Cole | 15/187 |

FOREIGN PATENT DOCUMENTS

| | | | |
|---|---|---|---|
| 3219836 | 12/1982 | Fed. Rep. of Germany | 132/88.7 |
| 0883900 | 7/1943 | France | 132/88.7 |
| 2099292 | 12/1982 | United Kingdom | 132/88.7 |

*Primary Examiner*—Robert P. Swiatek
*Assistant Examiner*—Cary E. Stone
*Attorney, Agent, or Firm*—Thomas I. Rozsa; Kenneth W. Iles

[57] ABSTRACT

The present invention relates to an Improved Mascara Applicator which is used to apply mascara to eyelashes. The Improved Mascara Applicator of the present invention incorporates a unique applicator design which contains a multiplicity of rows of closely spaced and evenly spaced applicator flukes which permits each eyelash to be evenly coated with mascara. The unique applicator design also incorporates a series of communicating channels between the multiplicity of rows of applicator flukes in order to permit mascara to flow from one row to the next. This built in mascara reservoir channel design feeds each of the mascara coating flukes with mascara in order to assure proper mascara flow to each eyelash. This unique design further eliminates the requirement of frequently dipping the mascara applicator into a pool of mascara to replenish the applicator.

The present invention also relates to an improved method of manufacturing the head of this mascara applicator.

1 Claim, 6 Drawing Figures

MASCARA APPLICATOR

BACKGROUND OF THE INVENTION

1. Field of the Invention

The present invention relates to an Improved Mascara Applicator which is used to apply mascara to eyelashes. The Improved Mascara Applicator of the present invention incorporates a unique applicator design which permits each eyelash to be individually separated and then evenly coated with mascara and further contains a built in mascara reservoir which feeds each of the mascara coating flukes with mascara in order to assure proper mascara flow to each eyelash and further eliminates the requirement of frequently dipping the mascara applicator into a pool of mascara to replenish the applicator.

The present invention also relates to an improved method of manufacturing the mascara applicator.

2. Description of the Prior Art

The conventional mascara applicator known in the prior art and commonly used by most manufacturers of mascara consists of a spiral brush wound around a central metal core. In one embodiment, the spiral begins at the front end of the brush and the brush lengths increase in diameter as the spiral extends along the brush. At approximately the midpoint, the maximum diameter is reached and the remainder of the brush is of uniform diameter. In an alternative embodiment, the brush can be cylindrical wherein the brush lengths are uniform along the length of the brush core. In yet another alternative embodiment, the brush can be barrel shaped, wherein the brush lengths at the mid-section are longer than the brush lengths at either end. The brush consists of fiber bristles which extend for 360 degrees around the core of the applicator in a continuous spiral. The conventional mascara applicator thus described is dipped into the pool of mascara contained within the mascara vial and then the coated applicator is used to coat the eyelashes with mascara. The mascara applicator known and used in the prior art has two significant disadvantages. First, there are wide gaps between adjacent spirals. As a result, because there are numerous eyelashes on the eyelid which are very closely spaced, the conventional mascara applicator cannot coat each eyelash individually. The result is that some eyelashes are coated with substantially more mascara than other eyelashes, thereby resulting in an uneven coating. In order to achieve a more uniform coating, the conventional mascara brush has to be frequently dipped to obtain more mascara and then a different section of the applicator is applied to the eyelashes on numerous occassions until all of the eyelashes have been coated. This requires a very time consuming operation and also requires a substantial expenditure and waste of mascara. Second, due to the spiral nature of the design of the bristles in the conventional mascara brush, there is no communication between nonadjacent rows of bristles. As a result, mascara cannot flow from one spiral row of bristles to other spiral rows of bristles. Therefore, mascara is frequently used up on some bristles while not so used on other bristles and there is no way for mascara to flow from one row to the next. As a result, there is once again uneven mascara coating and further the applicator must be frequently dipped to replenish bristles where the mascara has been used up. This also results in a time consuming process and a waste of mascara.

Another very significant disadvantage of the helically-wound nylon brush is that it tends to clump lashes into twos or even threes, because the dense cluster of hairs in the helix or spiral always has a large airspace next to it, into which the lashes are forced.

Therefore, the conventional mascara applicator which is known and used in the prior art does not provide an apparatus which permits each eyelash to be evenly coated and further does not provide an applicator design which permits mascara to flow from one row of applicator bristles to the next.

In the manufacture of mascara brushes which employ plastic rather than bristle brushes, the conventional technique is to entirely mold the brush. While this is expedient, it does not facilitate the creation of a brush which contains a large number of closely spaced bristles.

SUMMARY OF THE PRESENT INVENTION

The present invention relates to an Improved Mascara Applicator which is used to apply mascara to eyelashes. The Improved Mascara Applicator of the present invention incorporates a unique applicator design which contains a multiplicity of rows of closely spaced and approximately evenly spaced applicator flukes or tines which permit each eyelash to be individually separated and then evenly coated with mascara. The unique applicator design also incorporates a series of communicating channels between the multiplicity of applicator flukes in order to permit mascara to flow from one row to the next. This built in mascara reservoir channel design feeds each of the mascara coating flukes with mascara in order to assure proper mascara flow to each eyelash. This unique design further eliminates the requirement of frequently dipping the mascara applicator into a pool of mascara to replenish the applicator.

The present invention also relates to an improved method of manufacturing a mascara applicator brush. The present invention method incorporates a dual process of initially molding the basic mascara brush into a generally bullet shaped form which contains a multiplicity of axially aligned rows of spikes with a channel separating each row. The second step in the present invention process involves transversely grinding the rows of spikes at a large number of locations to thereby create a multiplicity of narrow spikes or flukes adjacent each other along each row.

It has been discovered, according to the present invention, that if a multiplicity of rows of closely and approximately evenly spaced applicator flukes are provided on the surface of the core of a mascara applicator head, then each row of flukes can be used to individually separate and supply mascara to an individual eyelash, thereby resulting in an even coating of all eyelashes with one application.

It has also been discovered, according to the present invention, that if each row of applicator flukes on the mascara applicator head extends along the entire 360 degree circumference of the applicator head, then the applicator can be rolled in one plane to assure that the same row of flukes coats the same eyelash to further assure a smooth and even coating of mascara over all of the eyelashes.

It has further been discovered, according to the present invention, that if each individual fluke in a row of flukes is aligned with the fluke in the preceding and succeeding row of flukes to thereby form a continuous straight line of approximately evenly spaced flukes along the length of the applicator head, then longitudinal channels are created between each longitudinal line of flukes which comprise the flukes in the various rows. The longitudinal channels thereby serve as reservoirs which permit mascara to flow from one row of flukes to the next row of flukes so that a row of flukes which is low on or has run out of mascara can be quickly and efficiently replenished through the communication flow of mascara from one row to the next.

It is therefore an object of the present invention to provide an improved mascara applicator which enables the user to evenly coat each individual eyelash through the use of a single application stroke.

It is another object of the present invention to provide an improved mascara applicator which permits the same row of applicator flukes to be in contact with the same eyelash while the mascara applicator is rotated, to thereby assure an even coating of the eyelash and to further eliminate any smudging or uneven coating which could result by an applicator row of flukes crossing over onto other eyelashes.

It is still a further object of the present invention to provide an improved mascara applicator which has a series of communicating channels which permits mascara to flow from one row of applicator flukes to the next row of applicator flukes and between applicator flukes in the same row to thereby provide a reservoir of mascara within the applicator head. As a result, dried flukes can be quickly replenished with mascara without requiring the frequent redipping of the applicator head into the pool of mascara within the applicator vial. This substantially increases the efficiency with which the mascara is used and applied, thereby eliminating waste of mascara and reducing the time during which the mascara is applied.

It is yet another object of the present invention to provide an improved method of manufacturing a mascara applicator brush which combines molding the basic brush form and grinding a multiplicity of spikes or flukes into the molded brush to achieve the above described brush design. In the preferred design, the axial channels are molded into the brush during the initial molding process and the circumferential channels between adjacent rows of flukes are ground into the brush.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
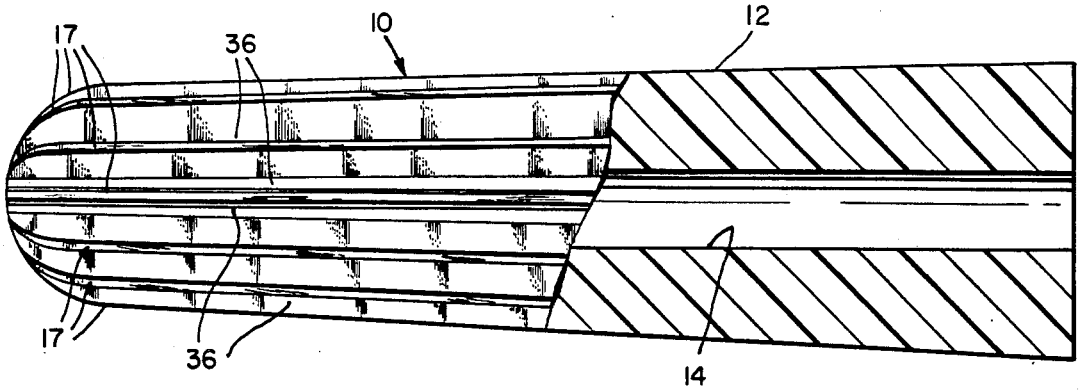
FIG. 1 is a partial side view and a partial cross-sectional view of the molded mascara applicator head core with the axial rows of flukes and axial channels molded in the brush and before the series of circumferential rows of flukes and intermediate circumferential channels have been machined into the mascara applicator head.

The head 10 of the Mascara Applicator 8 is molded by conventional injection molding techniques. Upon completion of the molding steps, the head is generally bullet or cone shaped with a multiplicity of axially aligned rows or lines of flukes molded into the head. Each row or line of spikes of flukes is separated from the adjacent axial row or line of spikes or flukes by an axially aligned channel. The head also may contain a hemispherical tip. The head can be made out of any elastomeric material such as plastic, vinyl or rubber. Other examples are olefinic, urethenic or styrenic rubber. FIG. 1 discloses a partial side view and a partial cross-sectional view of the molded mascara applicator head 10 after it has been injection molded. As shown in the side view portion, the outer surface 12 of the head 10 contains axially aligned flukes 17 separated by axially aligned channels 36. As shown in the partial cross-sectional view, the interior of the head 10 has a central opening 14 which has been molded into it during the injection molding process.

Figure 2:
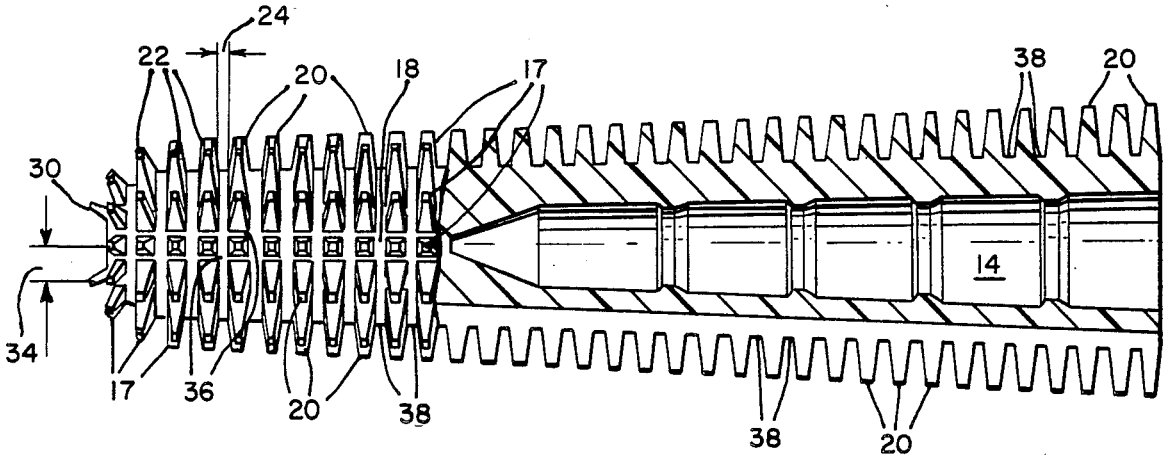
FIG. 2 is a partial side view and a partial cross-sectional view of the completed mascara applicator head, showing the completed rows of flukes and the internal core of the head which accommodates the stem of the applicator.

After the head 10 has been injection molded or formed from other manufacturing processes, a multiplicity of teeth or flukes are machined into the surface 12 by conventional techniques such as grinding or milling. The grinding or machining occurs at a multiplicity of locations along the lengths of each row of axially aligned flukes 17 to thereby form individual closely spaced teeth or flukes 20. Each circumferential row of flukes 20 is separated from an adjacent circumferential row by a circumferential groove 38. Each of the individual teeth or applicator flukes 20 is therefore ground into the head 10 after the molding process. The completed mascara applicator head 10 is shown in partial side view and partial cross-sectional view in FIG. 2. As shown in the partial side view section of FIG. 2, the mascara applicator head 10 has machined into its outer surface 12 a multiplicity of flukes 20 which project radially outward from the inner surface 18. Shapes for the applicator flukes 20 include a truncated pyramid or a frustrum with the base adjoining the surface 18 of the core of the head member 10. As shown in the side view section of FIG. 2, the flukes 20 are in spaced circumferential rows 22. The rows can be approximately evenly spaced apart. The distance 24 between each row 22 of flukes 20 can be approximately 0.025 inches. As shown in FIG. 2, the inner core surface 18 of the head 10 also extends further radially outward as the distance from the front tip 30 of the head member increases. Therefore flukes 20 which are closer to the tip 30 do not extend as far radially outward as those flukes 10 which are further away from the tip 30.

As further shown in the side view portion of FIG. 2, each fluke 20 in a given circumferential row 22 is aligned with all of the corresponding flukes in other rows 22 which are located at approximately the same circumferential location on the core surface 18 of the head 10. Therefore, in addition to being in rows 22, the flukes 20 are also in axial or longitudinal lines 34 which extend along the length of the head 10. As a result, channels 36 are formed between each line 34 of flukes 20. The approximate circumferential distance 32 between each of the respective lines of flukes can be approximately 0.025 inches. This also corresponds to the distance between each fluke 20 in a given row 22 although it is not necessary that the distances be the same.

Figure 3:
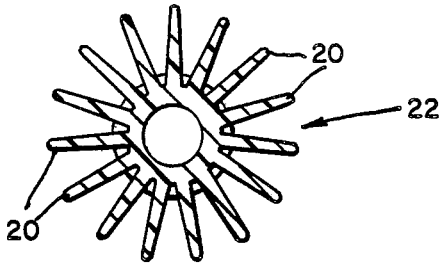
FIG. 3 is a front view of a row of applicator flukes showing one embodiment of the present invention with a multiplicity of thin flukes.
Figure 4:
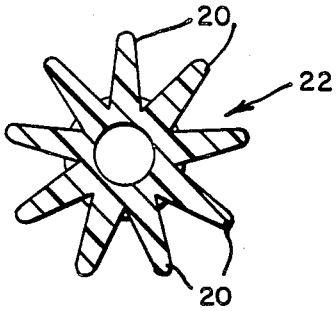
FIG. 4 is a front view of a row of applicator flukes showing an alternative embodiment of the present invention with a few thicker flukes composing the row.

FIGS. 3 and 4 disclose a front view of the applicator flukes 20 in two alternative embodiments. FIG. 3 discloses a multiplicity of thin applicator flukes 20 in each row 22 while FIG. 4 discloses an embodiment with fewer and thicker applicator flukes 20 in each row 22. It is within the spirit and scope of the present invention to have any multiplicity of flukes 20 in a given row 22. It is also within the spirit and scope of the present invention to have any multiplicity of rows 22 of flukes 20 extending along the length of the head member 10 in approximately even spaced longitudinal lines 34.

In some embodiments, it is not necessary or desirable to have all of the flukes evenly spaced as shown in FIG. 3 and FIG. 4. It is therefore within the spirit and scope of the present invention to have an uneven spacing of flukes around the circumference of the applicator head.

Figure 5:
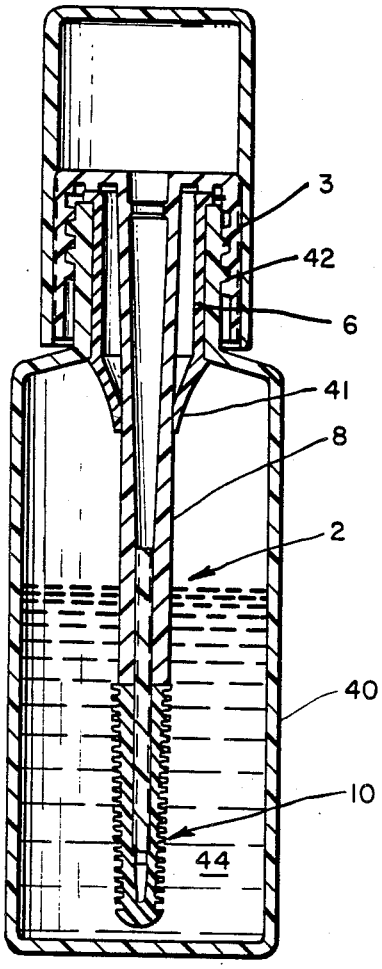
FIG. 5 is a cross-sectional view of a mascara vial with the improved mascara applicator head affixed to the applicator stem which is in turn affixed to the top of the vial.

Also shown in the cross-sectional portion of FIG. 2 is one embodiment of the final machined inner opening 14. The inner opening 14 is designed to accept the stem portion 8 of the applicator 2, as shown in FIG. 5. FIG. 5 is a cross-sectional view of a mascara vial 40 with the improved mascara applicator head 10 affixed to the applicator stem 8 which is in turn affixed to the top 6 of the vial 40. The top has internal threads 3 which are screwed onto threads 42 located at the upper portion of the mascara vial 40 so that the vial 40 can be tightly sealed when not in use. A pool of mascara 44 is located inside the vial 40 and surrounds the mascara applicator head 10 as well as the exposed portion of the stem 8.

Figure 6:
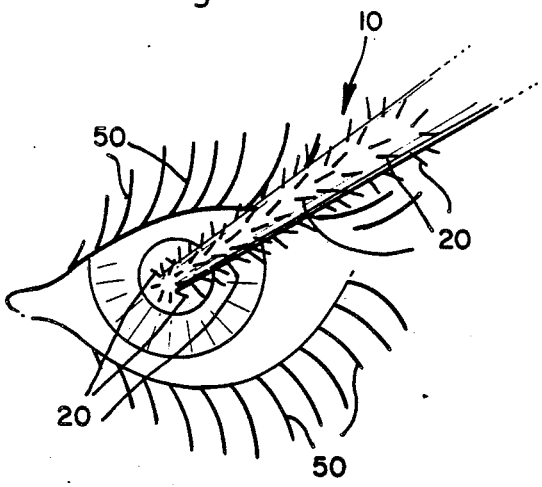
FIG. 6 is a view of the present invention in use showing each row of applicator flukes applying mascara to an individual eyelash.

The Improved Mascara Applicator 2 is used like other conventional mascara applicators. The top 6 of the mascara vial 40 is unscrewed and the applicator 2 which has been dipped in the mascara is removed in order to coat the eyelash with mascara 44. As the applicator 2 is removed from the vial 40, the wiper portion 41 of the vial 40 serves to skim excess mascara from the exterior of the stem or wand 8 of the applicator 2. As shown in FIG. 6, the eyelashes 50 are coated with mascara 44 in the following way. The mascara applicator 2 which consists of the top 6 of the vial 40, the stem 8 and the head 10 is dipped into the pool of mascara 44 in the vial 40 and then removed. The head 10 is held up to the eyelashes and each row 22 of applicator flukes 20 can be used to separate each eyelash 50 from adjoining eyelashes. Then the applicator flukes 20 are rubbed along the surfaces of the eyelashes 50 to coat them with mascara 44. The applicator 2 is held between the thumb and first finger so that it can be rolled to permit the applicator flukes 20 to be rotated and coat the eyelashes 50 with mascara 44. The rotation permits each successive applicator fluke 20 in the row 22 to come into contact with the eyelash 50. The row of applicator flukes is being used to coat the eyelashes.

The novel features of the present mascara applicator 2 are as follows. The multiplicity of rows 22 of closely spaced and approximately evenly spaced applicator flukes 20 permits each eyelash 50 to be separated and evenly coated with mascara 44. There are sufficient rows 22 so that each or only a few eyelashes are coated by an individual corresponding row 22 of flukes 20. Since a series of applicator flukes 20 all coated with mascara are in each row 22, the eyelash 50 can be evenly coated by rotating the applicator 2 so that one fluke 20 after another in a given row 22 comes in contact with the eyelash or few eyelashes 50 which are being coated with mascara 44. Since this same process is being used to coat all of the individual eyelashes 50, an even coating of mascara is assured for each eyelash.

Another novel feature of the mascara applicator 2 is the unique design wherein each individual fluke 20 in a row of flukes 22 is aligned with the fluke 20 in the preceding and successive rows 22 of flukes 20 to thereby form continuous straight lines 34 of flukes 20 along the length of the applicator head 10. As a result, longitudinal channels 36 are created between each longitudinal line 34 of flukes 20 which comprise the flukes 20 on the various rows 22. The longitudinal communicating channels 36 between the multiplicity of rows 22 of applicator flukes 20 permit mascara 44 to flow from one row 22 to the next. The longitudinal communicating channels 36 along the interior core surface 18 of the head 10 therefore act like mascara reservoirs 44 to feed each of the mascara applicator flukes 20 with mascara 44 in order to assure proper mascara flow to each eyelash 50. The width 32 of each of these channels 36 can be approximately 0.025 inches. In addition to the longitudinal channels 36, there are lateral channels 38 between each row 22 of flukes 20. As previously described, the distance 24 or width of these channels 38 can be approximately 0.025 inches. Therefore, mascara 44 can also flow in the lateral or circular direction along lateral channels 38 in addition to the longitudinal direction along channels 36. Therefore, this unique design of criss-crossed channels on the surface 18 of the core of the head 10 and at the base of each applicator fluke 20 assures that a proper supply of mascara 44 will be fed to each individual fluke 20. Therefore, each fluke 20 is properly supplied with mascara 44. This built in reservoir of criss-crossed channels therefore provides the additional advantage of eliminating the requirement of frequently dipping the mascara applicator head 10 into the pool of mascara 44 in the vial 40 to replenish the applicator head 10.

Therefore, through use of the present invention, each eyelash can be individually and evenly coated with mascara and further there is a built in reservoir supply channel to each individual applicator fluke to assure that each fluke will receive a proper amount of mascara to further assure even coating as well as eliminate the requirement of frequently redipping the applicator head to replenish dried flukes.

While the invention has been described as an Improved Mascara Applicator in order to define a fully operable invention, the novelty of the present invention is in the mascara coating head member which can be attached to any applicator embodiment and not just the stem and vial top arrangement discussed above. Therefore, the present invention can be more generally defined as a mascara applicator which contains among its parts an improved mascara coating head membering which has a generally cone shaped body. The mascara coating head member further comprises a multiplicity of lateral rows of applicator flukes which are spaced apart from one another along the length of the mascara coating head member and which radiate outwardly from the surface of the core of the mascara coating head member. Each of the applicator flukes in each of the rows is aligned with each corresponding applicator fluke in the preceding and successive rows at the same lateral location along the circumference of the head member to thereby form a multiplicity of longitudinal lines of applicator flukes which are spaced apart from one another. The spaces between each of the successive rows of applicator flukes and between each of the successive longitudinal lines of applicator flukes form a criss-cross pattern of channels between the applicator flukes along the surface of the core of the mascara coating head member at the base of each applicator fluke. Therefore, when the mascara applicator is placed in a pool of mascara such that the mascara coating head member is coated with mascara, each row of radially extending applicator flukes is used to separate one eyelash from the next and evenly coat it with mascara by rotation of the head member to bring each successive applicator fluke in the row into contact with the eyelash. Further, the criss-crossed pattern of channels between and at the base of the applicator flukes assures a proper supply of mascara to each applicator fluke.

Another portion of the present invention involves the novel method of manufacturing the head of the improved mascara applicator. The mascara applicator head is initially molded to form a core which contains a multiplicity of axially aligned lines of flukes with an axially aligned channel separating each axial line of flukes from the adjacent line of flukes. A multiplicity of closely spaced circumferential channels are then machined into the axially aligned lines of flukes to thereby form a multiplicity of flukes on the surface of the core which are separated by a criss-crossed pattern of axially aligned and circumferentially aligned channels. The machine can be any one of a number of methods such as grinding or laser burning. The head can be molded from any type of suitable material, such as those previously mentioned. Another example of an acceptable material is Hytrel, made by DuPont.

In the text, the widths of both the circumferential and axial channels have been illustrated as being approximately 0.025 inches. An important object of these distances is to match the pitch of human eyelashes. The pitch of human eyelashes ranges between 0.016 inches to 0.030 inches. Accordingly, the distances between adjacent axial rows of flukes can range from 0.016 inches to 0.030 inches and the distances between adjacent circumferential rows of flukes can range from 0.016 inches to 0.030 inches in various embodiment of the present invention. The distance 0.025 previously set forth is an acceptable medium.

Of course, the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms of modification in which the invention might be embodied or operated.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A method of manufacturing a mascara applicator comprising:

a. molding the head of an applicator producing a preform core having at least seven axially aligned substantially parallel fluke lines, each said fluke line separated from adjacent fluke lines by an axially aligned channel; and b. grinding a plurality of outwardly tapered, evenly spaced grooves into said fluke lines, said grooves being substantially perpendicular to the axis of the applicator.

* * * * *